US006210237B1

(12) United States Patent
Chang

(10) Patent No.: US 6,210,237 B1
(45) Date of Patent: Apr. 3, 2001

(54) MULTI-PORT MODULAR JACK ASSEMBLY AND METHOD FOR MAKING THE SAME

(75) Inventor: Yao Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/579,857

(22) Filed: May 25, 2000

Related U.S. Application Data

(63) Continuation of application No. 09/025,728, filed on Feb. 18, 1998, now abandoned.

(30) Foreign Application Priority Data

Feb. 18, 1997 (TW) ..... 86202819

(51) Int. Cl.[7] ..... H01R 1/648
(52) U.S. Cl. ..... 439/676; 439/607
(58) Field of Search ..... 439/324, 325, 439/607, 668–670, 676–680, 701

(56) References Cited

U.S. PATENT DOCUMENTS 5,478,261 * 12/1995 Bogese, II ..... 439/676
5,531,612 * 7/1996 Goddall et al. ..... 439/541.5
5,562,507 * 10/1996 Kan ..... 439/676
5,766,043 * 6/1998 Talend ..... 439/676
5,775,946 * 7/1998 Briones ..... 439/607
5,865,646 * 2/1999 Ortega et al. ..... 439/607
5,879,199 * 11/1999 Belopolsky ..... 439/701
5,987,725 * 11/1999 Belopolsky et al. ..... 439/607

* cited by examiner

*Primary Examiner*—Gary F. Paumen
(74) *Attorney, Agent, or Firm*—Wei Te Chung

(57) ABSTRACT

A multi-port modular jack assembly includes an insulative housing defining four ports, four insulative inserts each mounted with a set of eight contacts and fixedly received in a corresponding port, a grounding/shielding shell integrally formed with a front member mounted to the housing to enclose a top, right and left wall of the housing and a rear member bent to engage with the front member and enclose a rear side of the housing. The grounding/shielding has upper and lower grounding tabs projecting rearwardly and forwardly, respectively. The grounding/shielding shell further has two housing engaging tabs engaging with the right and left side walls of the housing at different levels relative to the bottom wall of the housing.

1 Claim, 7 Drawing Sheets

MULTI-PORT MODULAR JACK ASSEMBLY AND METHOD FOR MAKING THE SAME

CROSS-REFERENCE TO RELATED APPLICATIONS

This application is a Continuation Application (CA) of pending patent application Ser. No. 09/025,728 filed on Feb. 18, 1998 by the same inventor, now abandoned.

BACKGROUND OF THE INVENTION

1. Field of the Invention

The present invention relates to an electrical connector assembly, and particularly to a multi-port, telephone-type modular jack assembly for directly coupling a number of modular plugs to a printed circuit board. The present invention also relates to a method for making such a modular jack assembly.

2. The Prior Art

U.S. Pat. Nos. 5,531,612, 5,378,172, 5,419,720, 5,249,987 and 5,478,261 and Taiwan Patent Application Nos. 83213632, 83203192, 81204566, 83202859 and 82119692 disclose some conventional modular jacks/multi-port modular jack assemblies, wherein Taiwan Patent Application Nos. 82119692 and U.S. Pat. Nos. 5,249,987 and 5,478,261 emphasize contact design, Taiwan Patent Application Nos. 83203192, 83213632, 81204566 and U.S. Pat. No. 5,419,720 mainly relate to insulative housing design, and Taiwan Patent Application No. 83202859 addresses an electromagnetic shielding shell.

The conventional modular jack/jack assembly includes at least eight contacts for connecting with eight contacts of a mating telephone-type modular plug for transmitting electrical signals therethrough. Mounting the contacts of the prior art modular jacks/jack assemblies in housings thereof is laborious and troublesome. Thus, the assembly and production efficiency of the prior art is relatively low.

Furthermore, when the conventional modular jacks/jack assemblies are mounted to electronic devices, it is difficult for grounding/shielding shells thereof to be positively connected to grounding panels (usually, front or rear panels) of the electronic devices.

Moreover, the grounding/shielding shells of the conventional modular jacks/jack assemblies each consist of a number of separate members which are not easily assembled with the housings thereof.

Additionally, the contacts of the prior art modular jacks/jack assemblies have a configuration which will interfere with an insertion of mating modular plugs thereinto so that the mating modular plugs cannot be smoothly connected to the conventional modular jacks/jack assemblies.

Finally, in the prior art modular jacks/jack assemblies, engaging tabs of the shielding/grouding shells engaging with the plastic housings will interfere with neighboring modular jacks/jack assemblies so that the modular jacks/jack assemblies cannot be closely juxtaposed together.

Therefore, an improved modular jack/jack assembly is needed to eliminate the above mentioned defects of current modular jacks/jack assemblies.

SUMMARY OF THE INVENTION

Accordingly, an objective of the present invention is to provide an improved multi-port modular jack assembly having contacts which can be easily and quickly mounted within a housing of the modular jack assembly.

Another objective of the present invention is to provide a method for forming a multi-port modular jack assembly having an improved production/assembly efficiency.

A further objective of the present invention is to provide a multi-port modular jack assembly with a shielding/grounding shell which can be positively connected to a grounding panel of an electronic device when the jack assembly is mounted thereto.

Still another objective of the present invention is to provide a multi-port modular jack assembly having a shielding/grouding shell integrally formed with a front and a rear shielding/grounding member which can be easily assembled with a housing of the modular jack assembly.

Still a further objective of the present invention is to provide a multi-port modular jack assembly with contacts having a configuration which will not interfere with an insertion of mating plugs into the modular jack assembly.

A final objective of the present invention is to provide a multi-port modular jack assembly which can be closely juxtaposed together.

To fulfill the above objectives, according to one embodiment of the present invention, a multi-port modular jack assembly includes a dielectric housing defining four ports for respectively receiving four mating modular plugs, four dielectric inserts each having an L-shaped configuration with a vertical body defining two rows of alternating contact mounting holes and a horizontal plate defining eight contact passageways in communication with a space below the horizontal plate, four sets of eight contacts each having a free end connected to a common front blank portion, a V-shaped contact portion, a fit portion with barbs and a terminal portion perpendicular to the contact portion, and a grounding/shielding shell integrally formed with a front and a rear grounding/shielding member.

To assemble the jack assembly, a set of eight contacts are mounted to a corresponding insert by extending the terminal portions into the mounting holes to reach a position in which the free ends and the fit portions are received in the contact passageways and the V-shaped contact portions extend below the horizontal plate. Then, the insert together with the contacts is inserted into a corresponding port of the housing to reach a position in which the insert is fixed to the housing, eight pressing ribs formed on a bottom face of an upper wall of the housing depress the fit portions thereby fixing the contacts to the insert and the housing, and the V-shaped contact portions extend into the port.

Thereafter, the front blank portion is bent away from the free ends. The other three inserts and three sets of contacts are sequentially assembled to the housing in the same manner mentioned above. The front grounding/shielding member is then mounted to the housing by respectively extending two engaging tabs into two engaging recessions defined in two lateral walls of the housing whereby the front shielding/grounding member encloses the upper wall and the two lateral walls of the housing.

Finally, the rear grounding/shielding member which has two lateral wings is bent toward the front grounding/shielding member to respectively connect the two lateral wings with the two lateral walls of the front grounding/shielding member whereby a rear side of the housing is enclosed by a rear wall of the rear grounding/shielding member.

The two engaging recessions are positioned at different levels, whereby the modular jack assembly in accordance with the present invention can be closely juxtaposed together. The front rounding/shielding member has upper grounding tabs extending upwardly and rearwardly from a front end of the upper wall and lower grounding tabs extending downwardly and forwardly from a middle portion of a bottom wall thereof, whereby when the modular jack assembly is mounted to an electronic device, the shielding/grounding shell can be positively connected to a rounding panel of the electronic device via the grounding tabs.

DETAILED DESCRIPTION OF THE PREFERRED EMBODIMENTS

Reference will now be made in detail to the preferred embodiment of the present invention.

Figure 1:
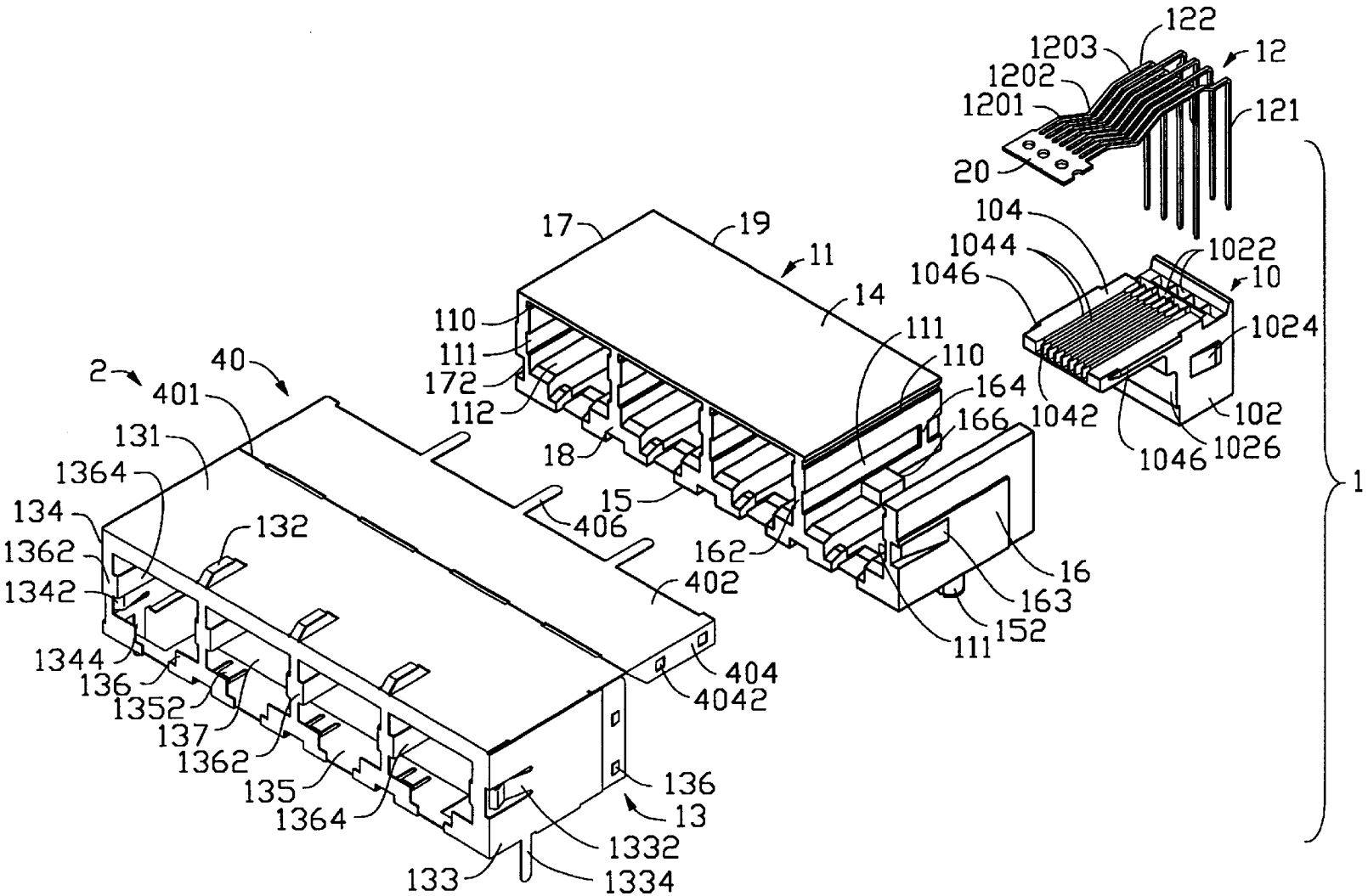
FIG. 1 is an exploded, perspective view showing the components which constitute a multi-port modular jack assembly in accordance with the present invention.

FIG. 1 shows a multi-port modular jack assembly 1 in accordance with the present invention. Also referring to FIGS. 4 and 5, the assembly 1 includes a housing 11 made by plastic injection molding with a top wall 14, a bottom wall 15, a right side wall 16, a left side wall 17, a front face 18 for connecting with mating modular plugs (not shown), a rear face 19 opposite the front face 18 and three partitions 162 to cooperatively define four modular plug receiving ports 112.

Figure 4:
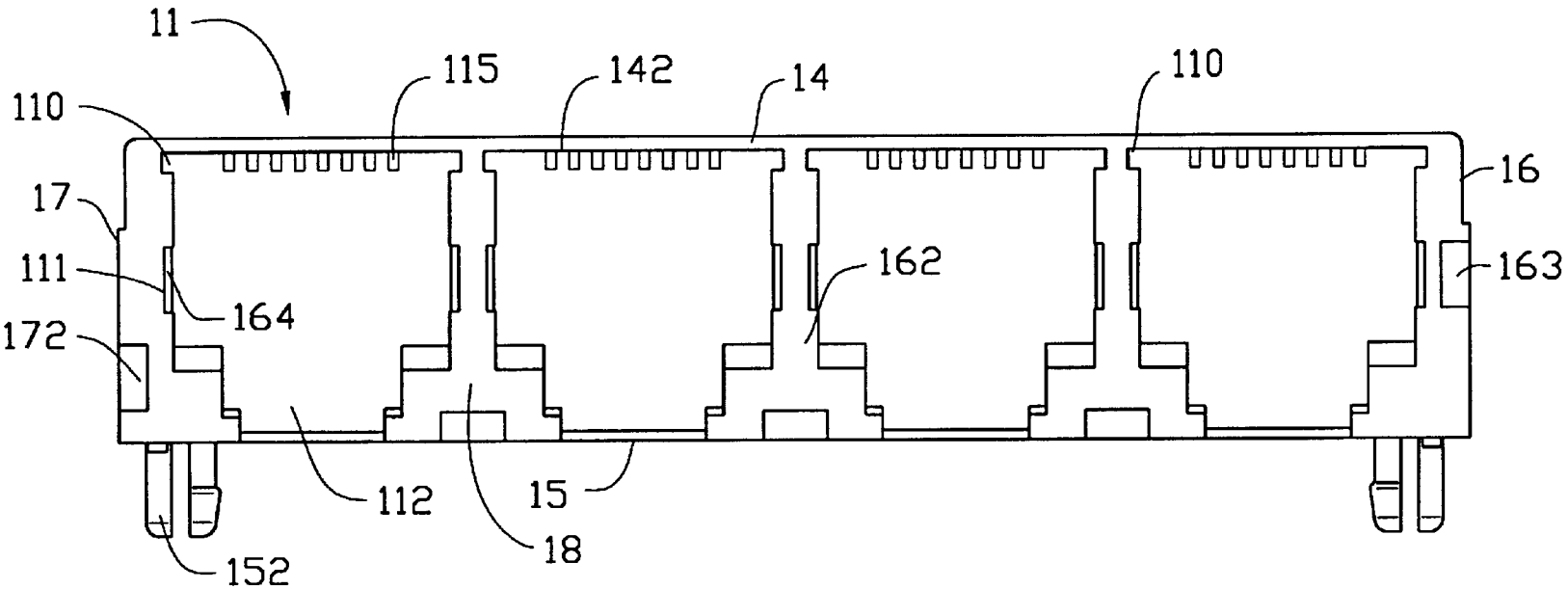
FIG. 4 is a front elevational view of a housing of the modular jack assembly in accordance with the present invention.
Figure 5:
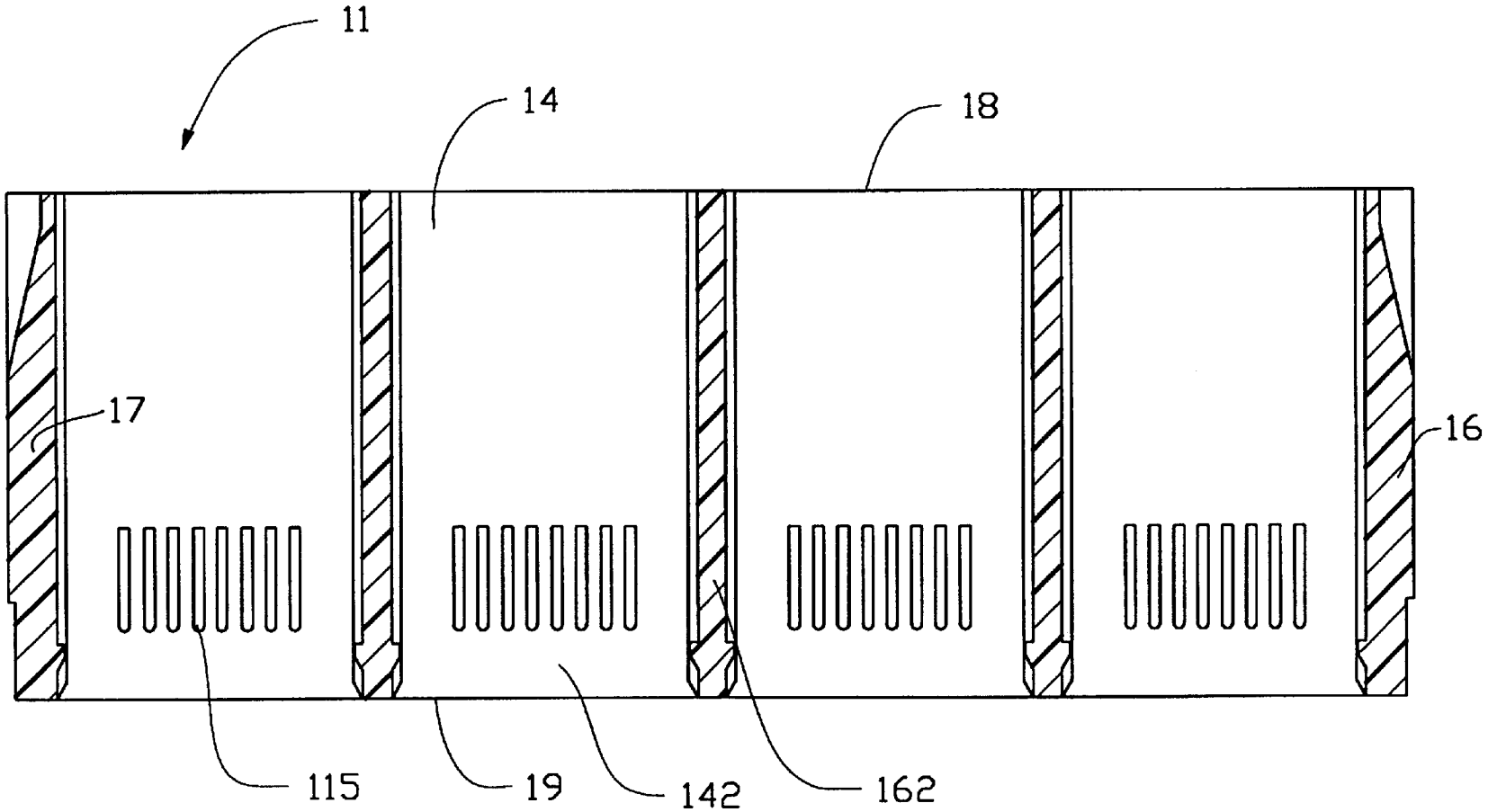
FIG. 5 is a cross-sectional view showing an inner surface of a top wall of a housing of the modular jack assembly in accordance with the present invention.

Particularly referring to FIGS. 4 and 5, the top wall 14 is formed with four sets of eight pressing ribs 115 extending downwardly from a rear portion (also seen in FIG. 6) of a bottom face 142 of the top wall 14 into the four modular plug receiving ports 112 respectively.

To clearly show the configuration of the ports 112, in FIG. 1, a part of the top wall 14 near the right side wall 16 is cut away. Each port 112 respectively defines a pair of guiding grooves 110 (only one shown in FIG. 1) on two upper, lateral sides thereof. Each of the partitions 162 and the right and left side walls 16 and 17 is formed with a protrusion 164 below a corresponding guiding groove 110 and defines a trench 111. The protrusions 164 are located in the trenches 111, respectively. The bottom wall 15 is formed with a stop face 166 in each of the ports 112. Two board locks 152 extend downwardly from two lateral sides of the bottom wall 15, respectively. The right side wall 16 defines a grounding/shielding shell engaging recession 163. The left side wall 17 also defines a grounding/shielding shell engaging recession 172 but at a lower level than the recession 163.

An insert 10 is formed by plastic injection molding to have a generally L-shaped configuration with a vertical body 102 and a horizontal plate 104. The body 102 defines two rows of four vertical holes 1022 therethrough. The holes 1022 in different rows have an alternating relationship. Two locking ridges 1024 are formed on two lateral sides of the body 102, respectively. An engaging face 1026 is formed on a front side of the body 102 below the horizontal plate 104. The horizontal plate 104 is formed with seven spacers 1042 to define eight contact passageways 1044, and two alignment rails 1046 on two respective lateral sides thereof.

Figure 7:
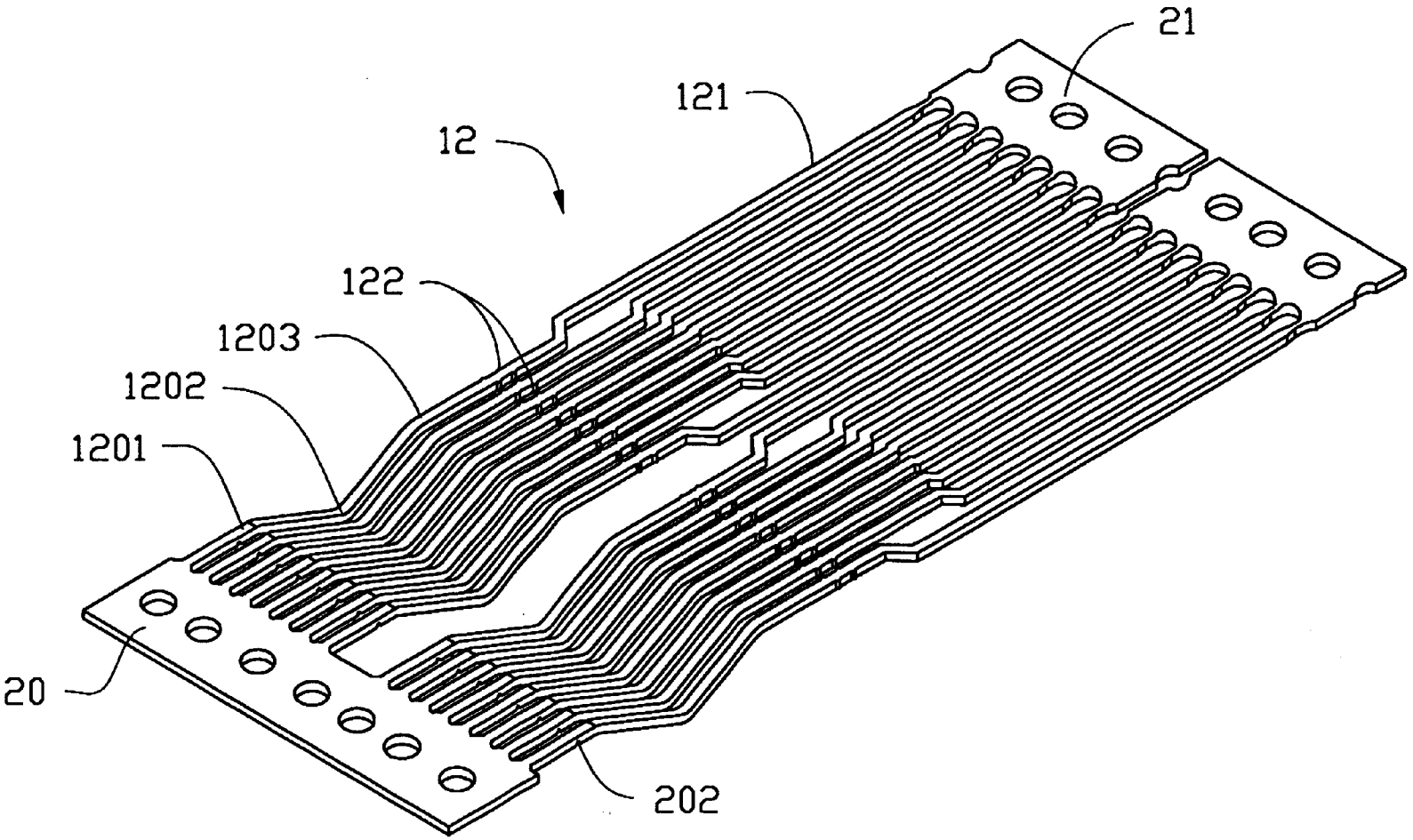
FIG. 7 is a perspective view of two sets of raw contacts in accordance with the present invention connected to a front and a rear blank portion.

Referring to FIG. 7, two sets of raw contacts 12 are formed by stamping a metal sheet. Each set includes eight contacts. Each contact 12 is formed with a free end 1201 in connection with a front blank portion 20, a V-shaped contact portion 1202, a fit portion 1203 with barbs 122 and a terminal portion 121 in connection with a rear blank portion 21. A notch 202 is defined in each of the raw contacts 12 between the free end 1201 and the front blank portion 20, whereby the front blank portion 20 can be easily removed from the free ends 1201 by bending the front blank portion 20 relative to the free ends 1201. The rear blank portion 21 is split thereby separating the two sets of raw contacts 12. Each set of raw contacts 12 can be further divided into two symmetrical groups along a middle line (not shown) thereof.

The terminal portion 121 of each contact 12 is laterally shifted from the contact portion 1202 thereof a distance which is increased in correspondence with the distance between the contact 12 and the middle line. In other words, the right-most contact 12 in FIG. 7, for example, has its terminal portion 121 laterally shifted from its contact portion 1202 a distance larger than the other three contacts of the corresponding group of the contacts 12.

To transform the contacts 12 from the configuration of FIG. 7 to that as shown in FIG. 1, the front blank portion 20 is further split to totally separate the two sets of raw contacts 12. Then, the rear blank portion 21 is cut away from the terminal portions 121. Finally, the terminal portions 121 are bent to have the configuration as shown in FIG. 1, wherein each odd contact (as counted from the right side of FIG. 1) is bent at a location closer to the terminal end thereof than the even contacts, whereby when the terminal portions 121 are fitted into the corresponding vertical holes 1022, the free ends 1201 and the fit portions 1203 are fitted into the corresponding contact passageways 1044 and the V-shaped contact portions 1202 project downward through slits 1048 (FIG. 3) defined in the plate 104 into a space below the plate 104 (best seen in FIG. 3).

Still referring to FIG. 1, the modular jack assembly 1 in accordance with the present invention has a grounding/shielding shell 2 consisting of a front grounding/shielding member 13 integrally formed with a rear grounding/shielding member 40 along a pivotable edge 401. The front grounding/shielding member 13 is formed with a top wall 131 having three upper grounding tabs 132 projecting rearwardly and upwardly from a front end thereof. A right side wall 133 is formed with a housing engaging tab 1332 horizontally projecting from a middle portion toward a front end thereof and a board mounting foot 1334 extending downwardly from a bottom edge thereof. Two buttons 136 are formed near a rear end of the right side wall 133. Like the right side wall 133, a left side wall 134 is also formed with a housing engaging tab 1342, a board mounting foot 1344 and two buttons (not shown). However, the housing engaging tab 1342 of the left side wall 134 is located at a lower level than the housing engaging tab 1332 of the right side wall 133. A bottom wall 135 is formed with three lower grounding tabs 1352 extending downwardly and forwardly from a middle portion of the bottom wall 135 (best seen in FIG. 6). By the design of the upper and lower grounding tabs 132, 1352 which project in opposing directions, when the modular jack assembly 1 is mounted to an electrical device, the grounding tabs 132, 1352 can positively engage with a grounding panel (usually a metallic front or rear panel of the electrical device) to ensure that the modular jack assembly 1 is firmly connected to the grounding panel.

A front wall 136 is formed with five columns 1362 generally connected with the front ends of the top and bottom walls 131, 135 to divide a front face of the front grounding/shielding member 13 into four openings 137. Four pairs of contacting tabs 1364 are formed extending rearwardly from the openings 137 along a length of each column 1362. The contacting tabs 1364 engage with grounding/shielding shells of mating modular plugs, whereby electrostatic charges carried by the modular plugs can be transmitted to ground via the grounding tabs 132, 1352 of the front grounding/shielding member 13 in connection with a grounding panel of an electrical device.

The rear grounding/shielding member 40 is formed with a rectangular rear wall 402 having a dimension slightly larger than that of the rear wall 19 of the housing 11. Two wings 404 (only one shown in FIG. 1) extend downwardly from two respective lateral edges of the rear wall 402, and three board mounting feet 406 extend rearwardly from a bottom edge of the rear wall 402. Each wing 404 defines two square holes 4042 therein.

Figure 6:
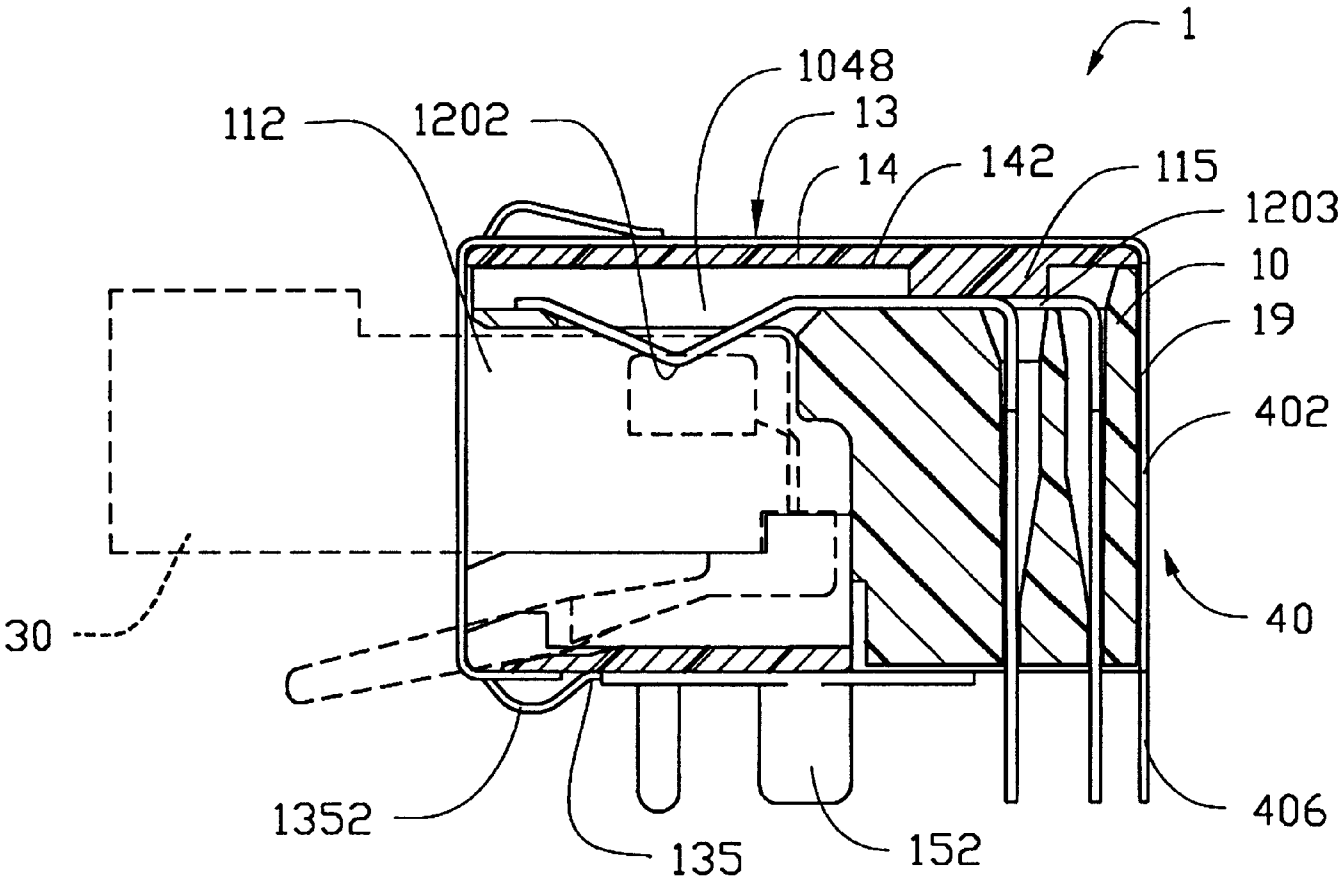
FIG. 6 is a cross-sectional view taken along line VI—VI of FIG. 2.

To assemble the modular jack assembly 1, the insert 10 together with the contacts 12 mounted thereon is inserted into the right-most plug receiving port 112 of the housing 11 from a rear opening (not labeled) thereof by sliding the alignment rails 1046 along the guiding grooves 110 to reach a position in which the engaging face 1026 abuts against the stop face 166 and the locking ridges 1024 surpass the protrusions 164 so that the rear edge (not labeled) of each protrusion 164 abuts against a front edge of the corresponding locking ridge 1024 whereby the insert 1 is securely fixed in the right-most plug receiving port 112. Thereafter, the eight pressing ribs 115 (FIGS. 4 and 5) on the bottom face 142 of the top wall 14 of the housing 11 depress the fit portions 1203 of the contacts 12 to cause the barbs 122 thereof to interferentially engage with the spacers 1042, whereby the contacts 12 are firmly fixed to the insert 10 within the housing 11 (FIG. 6).

Figure 3:
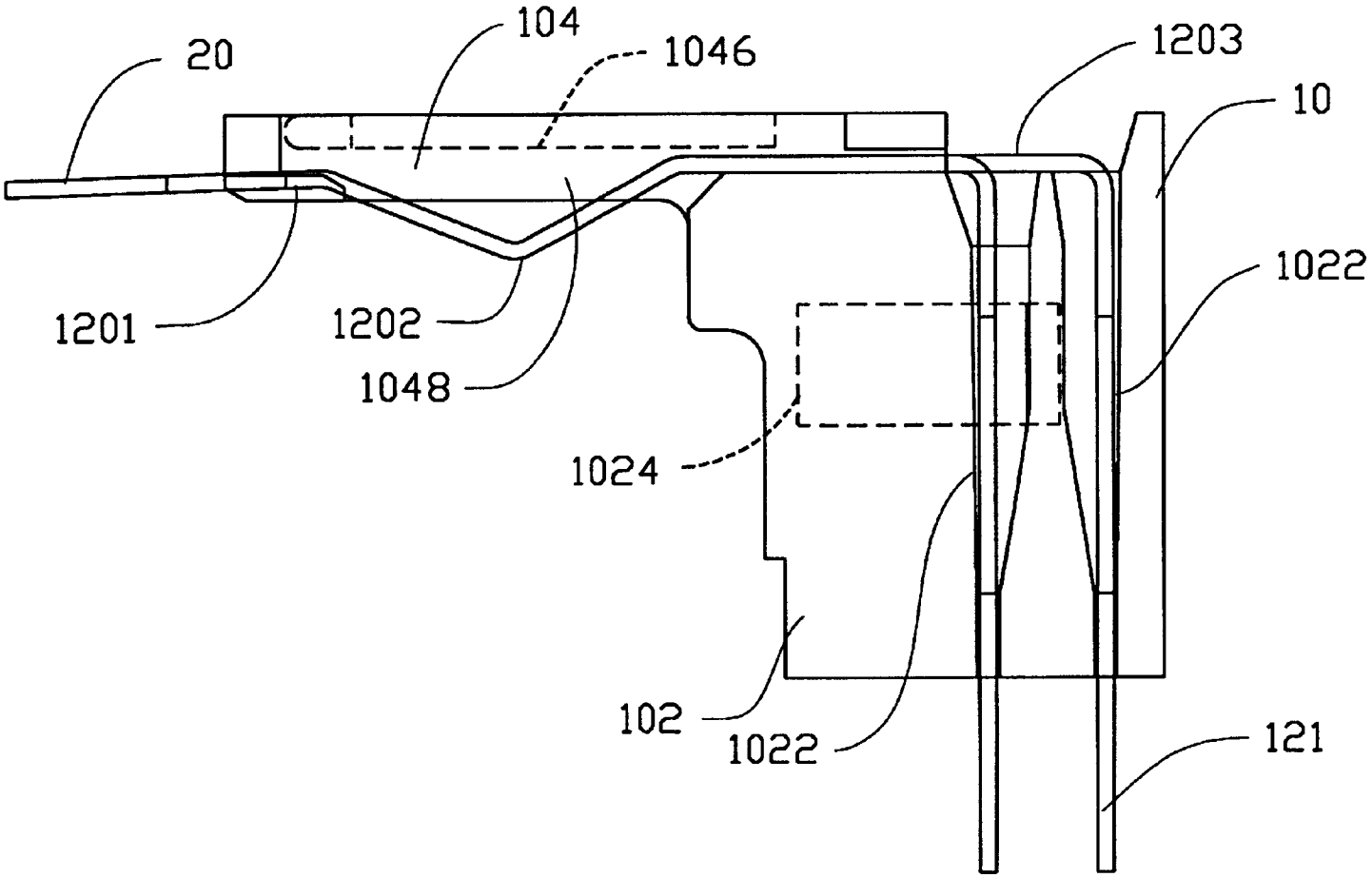
FIG. 3 is a diagrammatic side view showing contacts of FIG. 1 mounted to an insert of the modular jack assembly in accordance with the present invention.

FIG. 1 shows only one set of contacts 12 and one insert 10, however, it is understood by those skilled in the art that three inserts respectively mounted with three sets of contacts are each sequentially inserted into the other three plug receiving ports 112 in the manner as mentioned above so that the multi-port modular jack assembly 1 in accordance with the present invention connects with four modular plugs. The front blank portions 20 of the contacts 12 as shown in FIG. 3 are then bent away from the free ends 1201 thereof as shown in FIG. 6.

Next, the front grounding/shielding member 13 is mounted to the housing 11 by respectively sliding the housing engaging tabs 1332, 1342 of the front grounding/shielding member 13 into the recessions 163, 172 of the right and left side walls 16, 17 of the housing 11, and the contacting tabs 1364 are received in the corresponding trenches 111 to reach a position where the top, right and left walls 131, 133 and 134 of the front grounding/shielding member 13 enclose the top, right and left walls 14, 16 and 17 of the housing 11, respectively, and the bottom wall 135 of the front grounding/shielding members 13 confronts a front portion of the bottom wall 15 of the housing 11.

Figure 2:
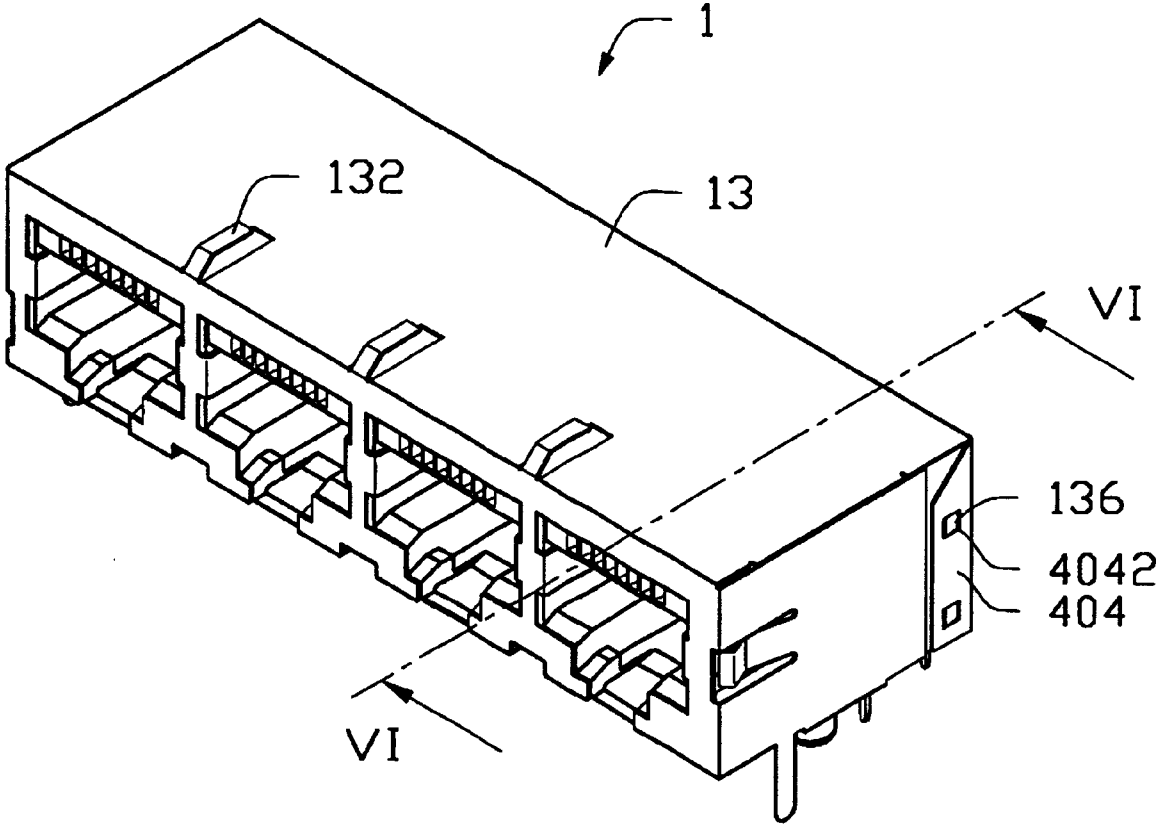
FIG. 2 is a perspective assembled view of the modular jack assembly of FIG. 1 wherein front blank portions of contacts of FIG. 1 are removed.

Finally, the rear grounding/shielding member 40 is bent along the pivotable edge 401 thereof toward the front grounding/shielding member 13 thereby causing the right and left wings 404 to engage with the right and left side walls 133, 134 of the front grounding/shielding member 13 by fixedly fitting the buttons 136 into the holes 4042 of the wings 404. Therefore, the assembly of the present modular jack assembly 1 is complete, as shown in FIG. 2, and the rear side 19 of the housing 11 is enclosed by the rear wall 402 of the rear shielding/grounding member 40 (best seen in FIG. 6).

To mount the modular jack assembly 1 onto an electric circuit board (not shown), the board locks 152 are fitted into holes defined in the board at predetermined positions. Then, the board together with the jack assembly 1 is subject to a soldering operation to solder the terminal portions 121 of the contacts 12 and the board mounting feet 1334, 1344, 406 to the board.

Referring to FIG. 6, the contact portions 1202 of the contacts 12 have a V-shaped configuration extending into the plug receiving port 112. Modular plugs 30 can, thus, be easily and smoothly inserted into the plug receiving ports 112 so that contacts of the modular plugs can electrically engage with the contact portions 1202 of the contacts 12.

Since the present invention has right and left housing engaging tabs 1332, 1342 of the front shielding/grounding member 13 located at different levels, the multi-port modular jack assembly 1 can be closely juxtaposed together without interference resulting between neighboring engaging tabs 1332, 1342.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A modular jack, comprising:

a dielectric housing having a front wall adapted for proximity to a mating modular plug, a rear wall opposite the front wall, a right side wall, a left side wall opposite the right side wall, a bottom wall adapted for being mounted to a printed circuit board and a top wall opposite the bottom wall, said walls cooperatively defining a rectangular hole therebetween;

an L-shaped dielectric insert fixedly received in the rectangular hole, having a vertical body located near the rear wall and defining a number of contact mounting holes and a horizontal plate perpendicularly and forwardly extending from an upper portion of the vertical body and located just below the top wall, said vertical body, horizontal plate, right, left side walls and front wall cooperatively defining a modular plug receiving port therebetween, said horizontal plate further defining a number of contact passageways in communication with the port via a number of slits formed in the horizontal plate;

a number of contacts having terminal portions received in the contact mounting holes, fit portions perpendicular to the terminal portions, forming a number of barbs and received in the contact passageways, contact portions in front of the fit portions extending into the port via the slits, and free ends in front of the contact portions received in the contact passageways; and a shielding/grounding shell mounted to the housing to enclose the top, right side, left side and rear walls of the housing, the shielding/grounding shell having a top wall and a bottom wall respectively having a first grounding tab and a second grounding tab projecting from the shell in opposite upward and downward directions;

wherein the first grounding tab further projects rearwardly, and the second grounding tab further projects forwardly;

wherein the top wall of the housing has pressing ribs formed thereon for depressing the fit portions of the contacts thereby interferentially fitting the barbs thereof into the horizontal plate of the insert;

wherein the shielding/grounding shell is integrally formed with a front member mounted to the housing to enclose the top, right side and left side walls thereof, and a rear member bent toward the front member to fixedly connect therewith and enclose the rear wall of the housing;

wherein the first grounding tab projects upwardly and rearwardly from a front end of the top wall of the front member, and the second grounding tab projects downwardly and forwardly from a middle portion of the bottom wall of the front member;

wherein the contact mounting holes are arranged in two rows wherein the holes in different rows have an alternating relationship;

wherein the contacts have a middle line to divide the contacts into two groups, and the terminal portion of each contact of each group is laterally shifted from the contact portion thereof a distance which is increased in correspondence with the distance between the contact and the middle line;

wherein the number of the contacts is eight, and the terminal portions of the odd contact counting from the right side wall of the housing are bent to be perpendicular to the fit portions thereof at a location behind where the terminal portions of the even contacts are bent;

wherein the front member of the shielding/grounding member further has two housing engaging tabs received in two shielding shell mounting recesses defined in the right side and left side walls of the housing, respectively, and wherein the two recesses are located at different levels so that the modular jack can be closely juxtaposed with another modular jack.

* * * * *